US011021912B2

(12) United States Patent
Bittleston et al.

(10) Patent No.: US 11,021,912 B2
(45) Date of Patent: Jun. 1, 2021

(54) ROTARY STEERING SYSTEMS AND METHODS

(71) Applicant: Schlumberger Technology Corporation, Sugar Land, TX (US)

(72) Inventors: Simon H. Bittleston, Cambridge (GB); Ashley Bernard Johnson, Cambridge (GB); Mauro Caresta, Cambridge (GB); Riadh Boualleg, Stonehouse (GB); Joachim Sihler, Cambridge (GB); Huseyin Murat Panayirci, Cambridge (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 39 days.

(21) Appl. No.: 16/025,480

(22) Filed: Jul. 2, 2018

(65) Prior Publication Data

US 2020/0003010 A1 Jan. 2, 2020

(51) Int. Cl.
*E21B 7/06* (2006.01)

(52) U.S. Cl.
CPC ..... *E21B 7/062* (2013.01)

(58) Field of Classification Search
CPC ... E21B 7/062; E21B 17/1014; E21B 17/1064
See application file for complete search history.

(56) References Cited

U.S. PATENT DOCUMENTS 1,635,593 A 7/1927 Wadsworth
2,142,859 A 1/1939 Mcmahan
2,179,567 A 11/1939 Strength
2,197,227 A 4/1940 Strength
2,212,594 A 8/1940 Evans
4,083,415 A 4/1978 Kita et al.
4,106,823 A 8/1978 Bassinger
4,947,944 A 8/1990 Coltman et al.
4,948,925 A 8/1990 Winters et al.
5,601,151 A 2/1997 Warren
5,931,239 A 8/1999 Schuh
5,941,323 A 8/1999 Warren
8,534,380 B2 9/2013 Sheppard et al.
8,727,036 B2 5/2014 Johnson et al.
8,899,352 B2 12/2014 Johnson et al.
(Continued)

FOREIGN PATENT DOCUMENTS

WO 2015127345 A2 8/2015
WO 2016187373 A1 11/2016

OTHER PUBLICATIONS

Combined Search and Exam Report under Sections 17 and 18(3) United Kingdom Patent Application No. 1705424.8 dated Jul. 27, 2017, 5 pages.

(Continued)

*Primary Examiner* — D. Andrews

(57) ABSTRACT

A drilling system that includes a drill bit that drills a bore through rock. A shaft coupled to the drill bit, wherein the shaft transfers rotational power to the drill bit. A housing that receives at least part of the shaft. A rotary steering system that controls a drilling direction of the drill bit. The rotary steering system includes a steering sleeve that couples to and uncouples from the housing to control a drilling direction of the drill bit.

18 Claims, 9 Drawing Sheets

(56) References Cited

U.S. PATENT DOCUMENTS

| | | | | |
|---|---|---|---|---|
| 9,109,402 | B1 | 8/2015 | Lasater et al. | |
| 9,714,543 | B2 | 7/2017 | Downie et al. | |
| 2002/0179336 | A1 | 12/2002 | Schaaf et al. | |
| 2006/0144623 | A1 | 7/2006 | Ollerensaw et al. | |
| 2008/0115974 | A1 | 5/2008 | Johnson et al. | |
| 2009/0044980 | A1 | 2/2009 | Sheppard et al. | |
| 2010/0116551 | A1 | 5/2010 | Southard | |
| 2010/0139983 | A1 | 6/2010 | Hallworth et al. | |
| 2011/0139513 | A1 | 6/2011 | Downton | |
| 2012/0080235 | A1 | 4/2012 | Sheppard et al. | |
| 2013/0213713 | A1 | 8/2013 | Smith et al. | |
| 2014/0262507 | A1* | 9/2014 | Marson | E21B 7/10 175/24 |
| 2016/0060959 | A1 | 3/2016 | Lehr et al. | |
| 2016/0060960 | A1 | 3/2016 | Parkin et al. | |
| 2017/0002608 | A1 | 1/2017 | Davis et al. | |
| 2017/0058617 | A1 | 3/2017 | Bartel | |
| 2018/0283103 | A1 | 10/2018 | Caresta | |
| 2020/0003009 | A1 | 1/2020 | Caresta et al. | |
| 2020/0003011 | A1 | 1/2020 | Sihler et al. | |

OTHER PUBLICATIONS

International Search Report and Written Opinion issued in International Patent Application No. PCT/US2018/025986 dated Jul. 27, 2018, 16 pages.

Office Action issued in U.S. Appl. No. 15/945,158 dated Jan. 18, 2019, 8 pages.

Office Action issued in U.S. Appl. No. 16/025,523 dated Mar. 10, 2020, 11 pages.

International Preliminary Report on Patentability issued in International Patent Application No. PCT/US2018/025986 dated Oct. 17, 2019, 14 pages.

Office Action issued in U.S. Appl. No. 16/025,441 dated Jul. 13, 2020, 15 pages.

Office Action issued in U.S. Appl. No. 16/025,523 dated Aug. 10, 2020, 12 pages.

First Office Action issued in Chinese Patent Application 201880042655.1 dated Oct. 28, 2020, 11 pages with partial English translation.

Office Action issued in U.S. Appl. No. 16/025,523 dated Dec. 28, 2020, 12 pages.

* cited by examiner

ROTARY STEERING SYSTEMS AND METHODS

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

The present disclosure generally relates to a steering assembly for directionally drilling a borehole in an earth formation. Directional drilling is the intentional deviation of a borehole from the path it would naturally take, which may include the steering of a drill bit so that it travels in a predetermined direction. In many industries, it may be desirable to directionally drill a borehole through an earth formation in order to, for example, circumvent an obstacle and/or to reach a predetermined location in a rock formation.

In the oil and gas industry, boreholes are drilled into the earth to access natural resources (e.g., oil, natural gas, water) below the earth's surface. These boreholes may be drilled on dry land or in a subsea environment. In order to drill a borehole for a well, a rig is positioned proximate the natural resource. The rig suspends and powers a drill bit coupled to a drill string that drills a bore through one or more layers of sediment and/or rock. After accessing the resource, the drill string and drill bit are withdrawn from the well and production equipment is installed. The natural resource(s) may then flow to the surface and/or be pumped to the surface for shipment and further processing.

Directional drilling techniques have been developed to enable drilling of multiple wells from the same surface location with a single rig, and/or to extend wellbores laterally through their desired target formation(s) for improved resource recovery. Each borehole may change direction multiple times at different depths between the surface and the target reservoir by changing the drilling direction. The wells may access the same underground reservoir at different locations and/or different hydrocarbon reservoirs. For example, it may not be economical to access multiple small reservoirs with conventional drilling techniques because setting up and taking down a rig(s) can be time consuming and expensive. However, the ability to drill multiple wells from a single location and/or to drill wells with lateral sections within their target reservoir(s) may reduce cost and environmental impact.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates generally to systems and methods for directionally drilling a borehole. In embodiments, a drilling system includes a drill bit that drills a bore through rock. A shaft is coupled to the drill bit, wherein the shaft transfers rotational power to the drill bit. A housing receives at least part of the shaft. A rotary steering system includes a steering sleeve that couples to and uncouples from the housing to control a drilling direction of the drill bit. In embodiments, a rotary steering system for controlling a drilling direction of a drill bit includes a steering sleeve that couples to and uncouples from a housing. A steering pad coupled to the steering sleeve rotates with the steering sleeve and forms a steering angle with the drill bit.

In other embodiments, a method of controlling a drilling direction of a drill bit may include disconnecting a steering sleeve from a housing, where the steering sleeve includes a steering pad that forms a steering angle with the drill bit. In embodiments, methods of the present disclosure may also actuate a piston to move radially with respect to a longitudinal axis of the steering sleeve to limit rotation of the steering pad.

Additional details regarding operations of the steering systems and methods of the present disclosure are provided below with reference to FIGS. 1-9.

Various refinements of the features noted above may be made in relation to various aspects of the present disclosure. Further features may also be incorporated in these various aspects as well. These refinements and additional features may be made individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION

Figure 1:
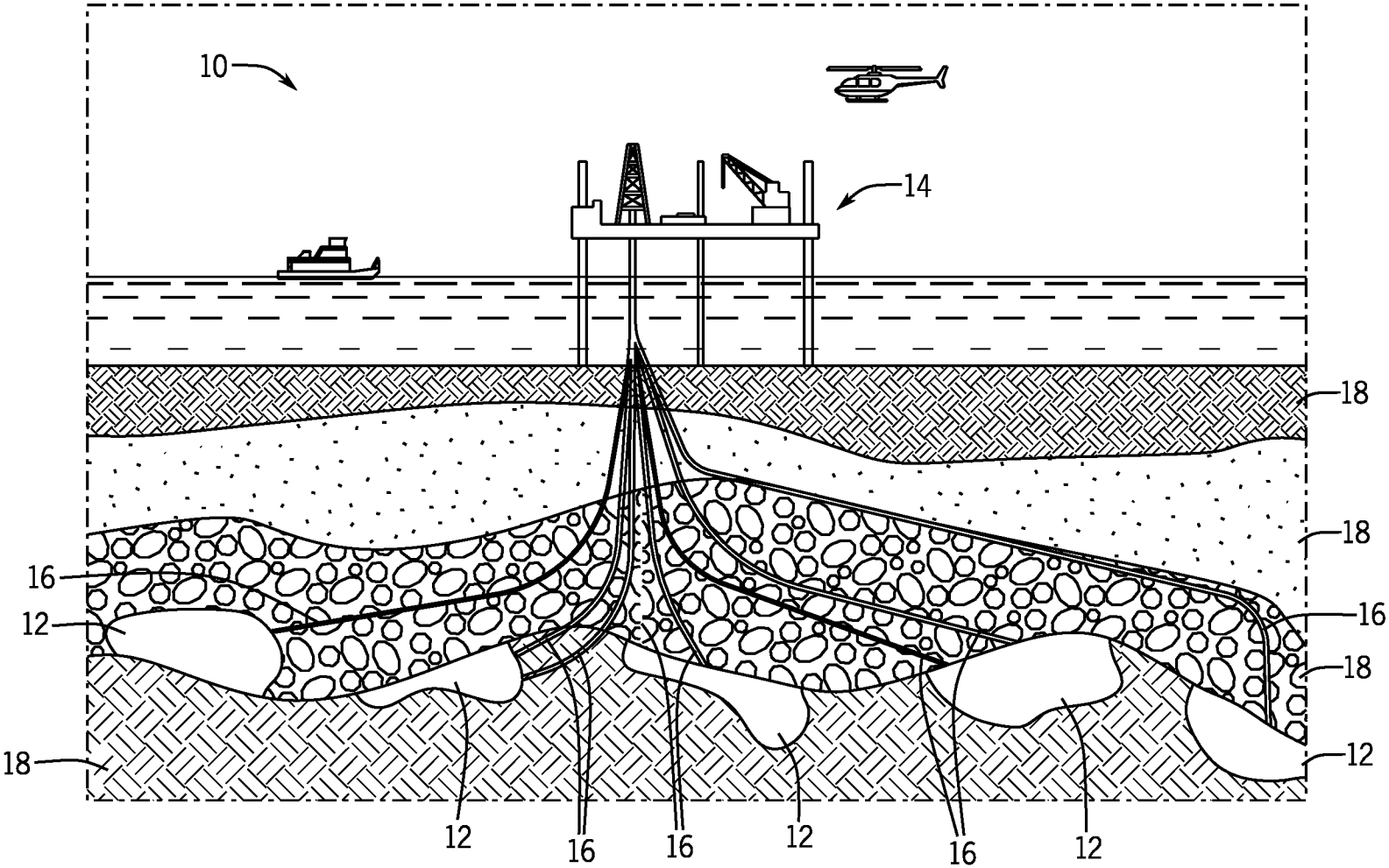
FIG. 1 schematically illustrates a rig coupled to a plurality of wells for which the rotary steering systems and methods of the present disclosure can be employed to drill the boreholes.

One or more specific embodiments of the present disclosure will be described below. These described embodiments are only exemplary of the present disclosure. Additionally, in an effort to provide a concise description of these exemplary embodiments, all features of an actual implementation may not be described. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The drawing figures are not necessarily to scale. Certain features of the embodiments may be shown exaggerated in scale or in somewhat schematic form, and some details of conventional elements may not be shown in the interest of clarity and conciseness. Although one or more embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

When introducing elements of various embodiments of the present disclosure, the articles "a," "an," and "the" are intended to mean that there are one or more of the elements. The terms "including" and "having" are used in an open-ended fashion, and thus should be interpreted to mean "including, but not limited to . . . ." Any use of any form of the terms "couple," "connect," "attach," "mount," or any other term describing an interaction between elements is intended to mean either a direct or an indirect interaction between the elements described. Moreover, any use of "top," "bottom," "above," "below," "upper," "lower," "up," "down," "vertical," "horizontal," "left," "right," and variations of these terms is made for convenience but does not require any particular orientation of components.

Certain terms are used throughout the description and claims to refer to particular features or components. As one skilled in the art will appreciate, different persons may refer to the same feature or component by different names. This document does not intend to distinguish between components or features that differ in name but not function, unless specifically stated.

The discussion below describes rotary steering systems and methods for controlling the orientation of a drill bit while directionally drilling a borehole. The steering assemblies of the present disclosure are disposed above the drill bit and include one or more over-gauge pads, where "over-gauge" refers to the pad having one or more points of extension greater than a nominal full-gauge or "gauge" as defined by a maximum drill bit cutter tip extension in a radial direction. Thus, for example, the radius of an over-gauge pad at a particular point is greater than the full-gauge radius of the drill bit in that radial direction. In embodiments, an over-gauge pad may include full-gauge and/or under-gauge area(s), where under-gauge refers to having one or more points of extension less than gauge as defined by a maximum drill bit cutter tip extension in that radial direction. Over-gauge pads will be referred to as "steering pads" below.

The maximum radial extension of a drill bit's cutter tips, and therefore the full-gauge radius, typically is (but need not be) substantially constant. A radius or gauge of a steering pad may or may not be substantially constant along its length in operation, i.e. at a given time, location, or degree of extension, as will be described further below. Moreover, at a given time, location, or degree of extension, steering pad radius may vary along its length and/or relative to a longitudinal axis of the drill string and/or on any plane perpendicular to the longitudinal axis.

FIG. 1 schematically illustrates an exemplary drill site 10 in which the systems and methods of the present disclosure can be employed. The drill site 10 may be located either offshore (as shown) or onshore, near one or multiple hydrocarbon-bearing rock formations or reservoirs 12 (e.g., for the production of oil and/or gas), or near one or more other subsurface earth zone(s) of interest. Using directional drilling and the rotary steering systems and methods presently described, a drilling rig 14 with its related equipment can drill multiple subsurface boreholes for wells 16 beginning from a single surface location for a vertical bore. Once completed. these wells 16 may fluidly connect to the same hydrocarbon reservoir 12 at different locations and/or to different reservoirs 12 in order to extract oil and/or natural gas.

As illustrated, each well 16 may define a different trajectory, including for example different degrees and/or lengths of curvature, in order to access and/or maximize surface area for production within the hydrocarbon reservoir(s) 12. The trajectory of a well 16 may depend on a variety of factors, including for example the distance between target reservoir (s) 12 and the rig 14, horizontal extension of a reservoir for hydrocarbon capture, as well as predicted and/or encountered rock stratigraphy, drilling obstacles, etc. between the surface and the subsurface drilling target(s). There may varying rock formation layers 18 between the rig 14 and a hydrocarbon reservoir 12, with some of layers 18 easily and relatively quickly drilled through, and other layers 18 time consuming and subject to increased wear on drilling components. The optimal trajectory to access a hydrocarbon reservoir 12 therefore may not be the shortest distance between the rig 14 and the hydrocarbon reservoir 12.

A drilling plan may be developed to include a trajectory for each proposed well 16 that takes into account properties (e.g., thicknesses, composition) of the layers 18. Following the drilling plan, borehole(s) for the well(s) 16 may be drilled to avoid certain layers 18 and/or drill through thinner portions of difficult layers 18 using directional drilling and/or to extend a substantially horizontal section through a reservoir 12. Directional drilling may therefore reduce drill time, reduce wear on drilling components, and fluidly connect the well 16 at or along a desired location in the reservoir 12, among other factors.

In FIG. 1, the rig 14 is an offshore drilling rig using directional drilling to drill the wells 16 below a body of water. It should be understood that directional drilling may be done with onshore rigs as well. Moreover, while the wells 16 may be wells for oil and gas production from hydrocarbon-bearing reservoirs, directional drilling is and can be performed for a variety of purposes and with a variety of targets within and outside of the oil and gas industry, including without limitation in water, geothermal, mineral, and exploratory applications. Additionally, while FIG. 1 illustrates multiple well 16 trajectories extending from one rig 14 surface location, the number of wells extending from the same or similar surface location may be one or otherwise may be more or less than shown.

Figure 2:
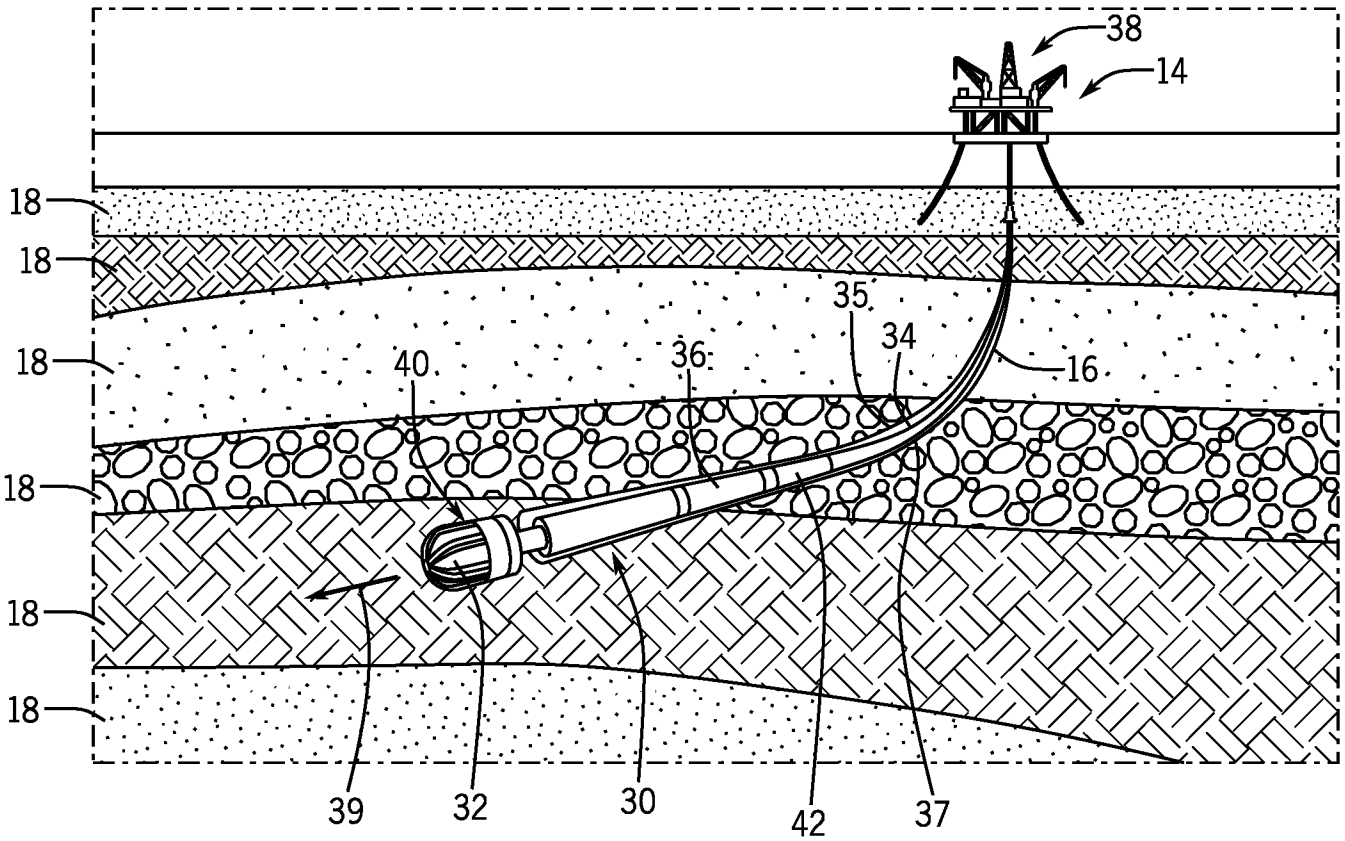
FIG. 2 schematically illustrates an exemplary directional drilling system coupled to a rig according to an embodiment of the present disclosure.

FIG. 2 schematically illustrates an exemplary directional drilling system 30 coupled to a rig 14. The directional drilling system 30 includes at bottom a drill bit 32 designed to break up rock and sediments into cuttings. The drill bit 32 couples to the rig 14 using a drill string 34. The drill string 34 is formed with a series of conduits, pipes or tubes that couple together between the rig 14 and the drill bit 32. In order to carry the cuttings away from the drill bit 32 during a drilling operation, drilling fluid, also referred to as drilling mud or mud, is pumped from surface through the drill string 34 and exits the drill bit 32. The drilling mud then carries the cuttings away from the drill bit 32 and toward the surface through an annulus 35 between an inner wall of the borehole 37 formed by the drill bit 32 and an outer wall of the drill string 34. By removing the cuttings from the borehole 37 for a well 16, the drill bit 32 is able to progressively drill further into the earth.

In addition to carrying away the cuttings, the drilling mud may also power a hydraulic motor 36 also referred to as a mud motor. Drilling mud is pumped into the borehole 37 at high pressures in order to carry the cuttings away from the drill bit 32, which may be at a significant lateral distance and/or vertical depth from the rig 14. As the mud flows through the drill string 34, it enters a hydraulic motor 36. The flow of mud through the hydraulic motor 36 drives rotation of the hydraulic motor 36, which in turn rotates a shaft coupled to the drill bit 32. As the shaft rotates, the drill bit 32 rotates, enabling the drill bit 32 to cut through rock and sediment. In some embodiments, the hydraulic motor 36 may be replaced with an electric motor that provides power to rotate the drill bit 32. In still other embodiments, the directional drilling system 30 may not include a hydraulic motor or electric motor on the drill string 34. Instead, the drill bit 32 may rotate in response to rotation of the drill string 34 from at or near the rig 14, for example by a top drive 38 on the rig 14, or a kelly drive and rotary table, or by any other device or method that provides torque to and rotates the drill string 34.

In order to control a drilling direction 39 of the drill bit 32, the directional drilling system 30 may include a rotary steering system 40 of the present disclosure. As will be discussed in detail below, the rotary steering system 40 includes a steering sleeve with one or more steering pads oriented to change and control the drilling direction 39 of the drill bit 32. The rotary steering system 40 may be controlled by an operator and/or autonomously using feedback from a measurement-while-drilling system 42. The measurement-while-drilling system 42 uses one or more sensors to determine the well path or borehole drilling trajectory in three-dimensional space. The sensors in the measurement-while-drilling system 42 may provide measurements in real-time and/or may include accelerometers, gyroscopes, magnetometers, position sensors, flow rate sensors, temperature sensors, pressure sensors, vibration sensors, torque sensors, and/or the like, or any combination of them.

Figure 3:
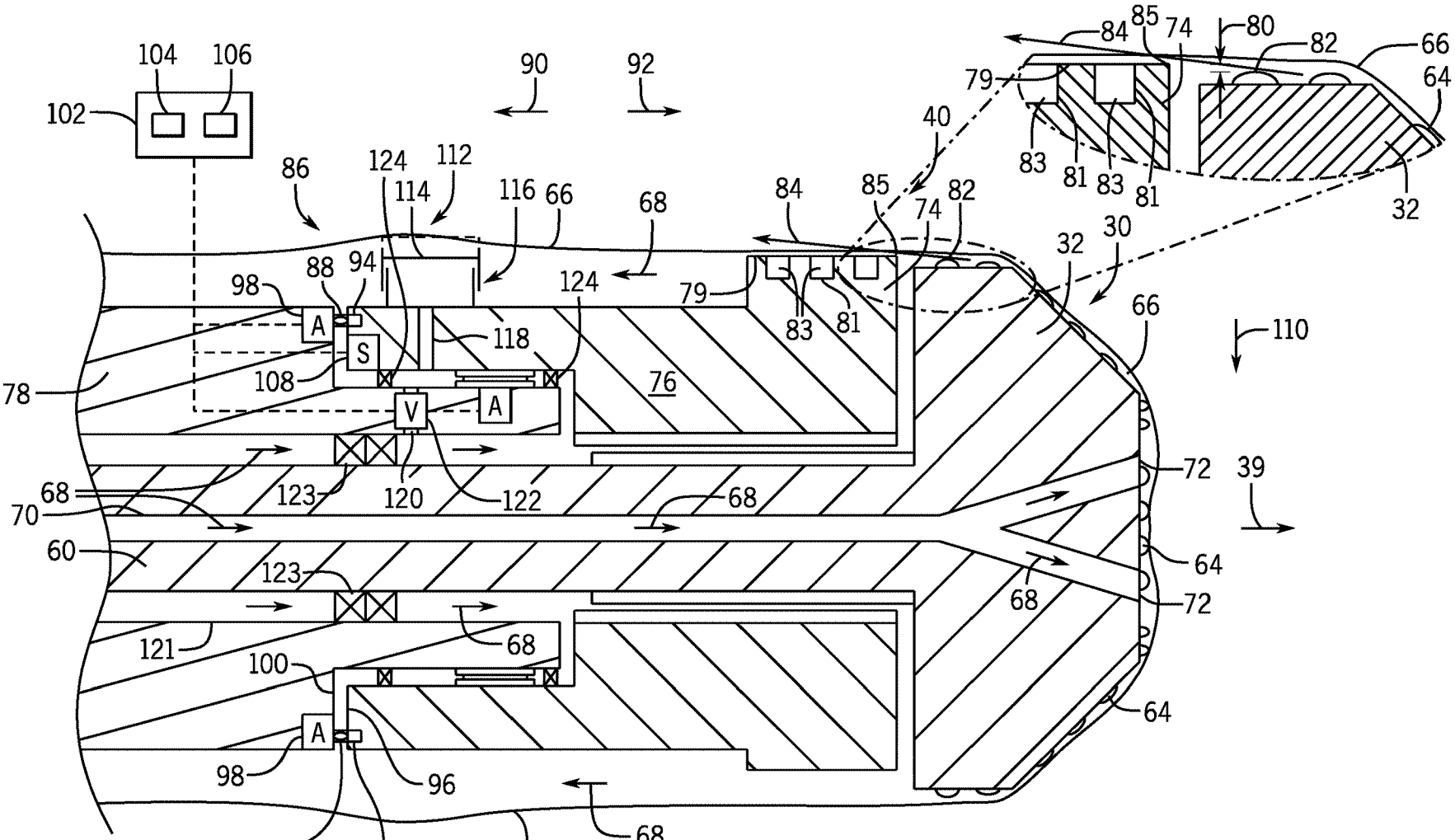
FIG. 3 is a cross-sectional view of a directional drilling system with a rotary steering system according to an embodiment of the present disclosure.

FIG. 3 is a cross-sectional view of an embodiment of a directional drilling system 30 with a rotary steering system 40 of the present disclosure. As explained above with reference to FIG. 2, the directional drilling system 30 includes at bottom a drill bit 32 capable of cutting through rock and/or sediment to drill a borehole for a well 16. The drill bit 32 may be powered by a motor (e.g., hydraulic or mud motor, electric motor) that in operation transfers torque to the drill bit 32 through a drive shaft 60. The drill bit 32 may couple to the drive shaft 60 with one or more bolts 62 enabling power transfer from the motor. As the drive shaft 60 rotates, torque drives rotation of the drill bit 32, enabling cutters or teeth 64 (e.g., polycrystalline diamond teeth) to grind into the rock face 66. As the teeth 64 grind against the rock face 66, the rock face 66 breaks into pieces called cuttings. The cuttings are then carried away from the rock face 66 with drilling mud 68. The drilling mud 68 flows through a conduit or passageway 70 in the drive shaft 60 and then through openings, nozzles or apertures 72 in the drill bit 32, carrying the cuttings around the drill bit 32 and back through the recently drilled bore.

In order to steer the directional drilling system 30 and more specifically control the orientation of the drill bit 32, the directional drilling system 30 of the present disclosure includes the rotary steering system 40. The rotary steering system 40 in FIG. 3 includes one or more steering pads 74 (e.g., one, two, three, four, five, six or more steering pads) that couple to a steering sleeve 76. The steering sleeve 76 couples to a housing 78 that receives the shaft 60. In some embodiments, the housing 78 may be referred to as a motor collar. In some embodiments, the drilling motor is configured to generate torque and first rotational speed (revolutions per minute (RPM)) to power the drive shaft 60 that is part of the motor, and the drive shaft 60 causes the drill string 34 to rotate at a second rotational speed or RPM. In some embodiments, there is no drive shaft 60 and the bit 32 is part of or integral to the housing 78, in which case the torque and RPM are fully provided by the drill string 34.

In operation, the steering sleeve 76 rotates as the drill string 34 rotates. As will be explained in detail below, by coupling and uncoupling the steering sleeve 76 from the housing 78, the rotary steering system 40 uses the rotation or non-rotation of the housing 78 to control steering of the drill bit 32.

The steering pad(s) 74 may be formed as one piece with the steering sleeve 76, as shown, or may be formed separately and then coupled to the steering sleeve 76, for example by bolting, brazing, welding, or fastening (e.g., by threaded fasteners), or the like. In some embodiments, a steering pad 74 may include a body made out of a first material such as carbide (e.g., tungsten or other transition metal carbide). The body may define a curvilinear surface 79 configured to engage the rock face 66 described above. The body may also include a plurality of counterbores 81 in the curvilinear surface 79. These counterbores 81 enable the steering pad 74 to receive a plurality of inserts 83. The inserts 83 may include diamond inserts, boron nitride inserts, tungsten carbide inserts, or a combination thereof. The inserts 83 may be conventional polycrystalline diamond cutters (PDC or PCD cutters). These inserts 83 provide abrasion resistance as the steering pad 74 contacts the rock face 66.

As illustrated, the steering pad 74 extends a radial distance 80 beyond the outermost radial surface 82 of the drill bit 32 as defined by the outermost cutter extension, which places the steering pad(s) 74 into contact with the rock face 66 surrounding the bore. In other words, the steering pad 74 is over-gauge, and the radial distance 80 is an over-gauge radial distance. For example, the over-gauge radial distance 80 may be in a range between about 0.1 to 20 mm, 0.1 to 10 mm, and/or 0.1 to 5 mm. In embodiments, the steering sleeve also may include an under-gauge section opposite the over-gauge section, as described in U.S. patent application Ser. No. 15/945,158, incorporated by reference herein in entirety for all purposes.

By contacting the rock face 66 the steering pads 74 are able to (passively) force the drill bit 32 in a particular direction (i.e., steer the drill bit 32). More specifically, the steering pad 74 forms a steering angle 84 between the drill bit 32 (e.g., outermost surface of a cutter of the drill bit 32) and an edge 85 of the steering pad 74. This steering angle 84 enables the steering pad 74 to change the drilling direction 39 of the drill bit 32. However, if the steering sleeve 76 rotates with the housing 78, the influence of the steering pad 74 is negligible or even nonexistent because the effects of the steering pad 74 are felt equally about the circumference of the drill bit 32. In other words, the effect of the steering pad 74 in a first position is neutralized or canceled when the steering pad 74 is rapidly rotated to a second position that is one hundred and eighty degrees from the first position or continuously rotated at a speed similar to or lower than the drill bit 32.

Accordingly, in order for the steering pad 74 to change the drilling direction of the drill bit 32, the steering pad 74 is held in place at a particular circumferential position relative to the bore/earth. And in order to block or reduce rotation of the steering pad 74, the steering sleeve 76 is uncoupled from the housing 78.

The steering sleeve 76 couples and uncouples to the housing 78 with a locking system 86. In some embodiments, the locking system 86 may include one or more pins 88 (e.g., one, two, three, four, five, six, seven, eight, nine, ten or more pins) that move axially in directions 90 and 92 to couple and uncouple the steering sleeve 76 and housing 78. More specifically, the pins 88 engage apertures 94 on an end face 96 of the steering sleeve 76 to couple the housing 78 to the steering sleeve 76. In some embodiments, the pins 88 may radially engage a portion of the steering sleeve 76 overlapped by the housing 78. In some embodiments, instead of pins 88 the housing 78 and steering sleeve 76 may couple together or engage with gear teeth of dogs, or any other mechanism known in the art to selectively lock and unlock a torsional coupling, including without limitation a sleeve brake system (see, e.g., discussion below with reference to FIG. 4 (item 142)) which may be sufficiently powerful to remove the need for pins 88 or the like. In some embodiments, there may be a mechanical friction brake with friction pads similar to a clutch (see, e.g., discussion below with reference to FIG. 5 (item 160)).

The pins 88 are controlled with actuators 98. The actuators 98 may be mechanical actuators and/or hydraulic actuators capable of extending the pins 88 in axial direction 92 to engage the steering sleeve 76 and to retract the pins 88 in axial direction 90 to uncouple them from and thereby disengage the steering sleeve 76. In FIG. 3, the actuators 98 are coupled to the housing 78, but in some embodiments the actuators 98 may be coupled to the steering sleeve 76. Actuators 98 on the steering sleeve 76 would accordingly extend the pins 88 into and retract them from apertures in an end face 100 of the housing 78. In some embodiments, there may be a combination of actuators 98 on both the steering sleeve 76 and on the housing 78 that axially move pins 88 to couple and uncouple the steering sleeve 76 and the housing 78.

To control the lock system 86, the rotary steering system 40 may include a controller 102 a processor 104 and a memory 106. For example, the processor 104 may be a microprocessor that executes software to control the operation of the actuators 98. The processor 104 may include multiple microprocessors, one or more "general-purpose" microprocessors, one or more special-purpose microprocessors, and/or one or more application specific integrated circuits (ASICs), or some combination thereof. For example, the processor 104 may include one or more reduced instruction set computer (RISC) processors.

The memory 106 may include a volatile memory, such as random access memory (RAM), and/or a nonvolatile memory, such as read-only memory (ROM). The memory 106 may store a variety of information and may be used for various purposes. For example, the memory 106 may store processor executable instructions, such as firmware or software, for the processor 104 to execute. The memory may include ROM, flash memory, a hard drive, or any other suitable optical, magnetic, or solid-state storage medium, or a combination thereof. The memory may store data, instructions, and any other suitable data. The controller 102 may be positioned on the rig 14 and/or may be part of the measurement while drilling system 42 on the drill string 34, for example.

In operation, the controller 102 may receive feedback from one or more sensors 108 (e.g., position sensors) that detect the position of the steering sleeve 76 and by extension the position of the steering pads 74 with respect to the drill bit 32. Using feedback from the sensors 108, the controller 102 is able to control the actuators 98 to uncouple the steering sleeve 76 from the housing 78 in order to position the steering pad 74 in a desired position relative to the bore/earth. In the position shown in FIG. 3, the steering pad 74 creates a displacement through contact with the rock face 66 that drives the drilling bit 32 toward lateral direction 110.

In order to maintain the steering pad 74 in a desired position relative to the bore/earth, the rotary steering system 40 may include a steering brake system 112. The steering brake system 112 may include a brake pad 114 that is capable of moving both radially outward and inward to engage and disengage, respectively, the rock face 66. In operation, the brake pad 114 creates friction with the rock face 66 to maintain the steering pad 74 in a specific position relative to the bore/earth. In other words, the brake pad 114 is configured to prevent slipping/rotation of the steering pad 74 relative to the bore/earth. In some embodiments, the brake pad 114 is axially aligned with or substantially axially aligned with the steering pad 74 with respect to a central longitudinal axis of the steering sleeve 76. In some embodiments, the brake pad 114 and steering pad 74 may offset from one another about the circumference of the steering sleeve 76. For example, the brake pad 114 and the steering pad 74 may be offset from each other about the circumference of the steering sleeve 76 in a range between about 1 to 30 degrees, 1 to 90 degrees, 1 to 180 degrees, and/or 1 to 360 degrees. It should be understood that while a single brake pad 114 is illustrated, the steering brake system 112 may include multiple brake pads 114, for example, two, three, four, five or more brake pads 114, spaced about the circumference of the steering sleeve 76. These brake pads 114 may be evenly or unevenly spaced about the circumference of the steering sleeve 76. In some embodiments, the steering brake pads 114 may be axially as well as radially offset from each other. In some embodiments, the brake pad 114 may be passive (e.g., not actively controlled) and/or in substantially continuous contact with the formation. In embodiments, there may be no brake pad at all.

The brake pad 114 may be composed of the same materials as the steering pad 74 (e.g., carbide with polycrystalline diamond inserts). In other embodiments, the material of the brake pad 114 (e.g., steel) may differ from that of the steering pad 74 (e.g., carbide). In FIG. 3, the brake pad 114 shown is actuated with a hydraulic piston 116. In some embodiments, the hydraulic piston 116 may be pressurized and driven using the pressurized drilling mud 68 flowing through the directional drilling system 30. For example, the steering sleeve 76 and the housing 78 may include respective apertures 118 and 120 that enable pressurized drilling mud 68 to flow from the cavity 121 to the hydraulic piston 116. The flow of pressurized drilling mud 68 to the hydraulic piston 116 is controlled with a valve 122 that couples to the controller 102. The valve 122 may be located on the housing 78 to control the flow of drilling mud 68 through the aperture 120. In another embodiment, the valve 122 may located on the steering sleeve 76 to control the flow of drilling mud 68 through the aperture 118. In still other embodiments, both the housing 78 and the steering sleeve 76 may include respective valves to control fluid flow through the respective apertures 120 and 118. When the valve 122 opens, pressurized drilling mud 68 is able to flow through the apertures 120 and 118 to actuate the hydraulic piston 116. Actuation of the hydraulic piston 116 drives the brake pad 114 radially outward with respect to the steering sleeve 76 and into contact with the rock face 66. The friction between the brake pad 114 and the rock face 66 reduces or blocks rotation of the steering sleeve 76 and thus maintains the steering pad 74 in a desired position to control the drilling direction 39 of the drill bit 32. In some embodiments, the rotary steering system 40 may include seals and/or bearings 124 (e.g., circumferential seals) between the housing 78 and the steering sleeve 76 that direct the drilling mud 68 flowing through the aperture 120 to the aperture 118. In some embodiments, the steering system 40 may not include the valve 122, enabling the hydraulic piston 116 to be constantly actuated when drilling mud is flowing through the directional drilling system 30.

Figure 4:
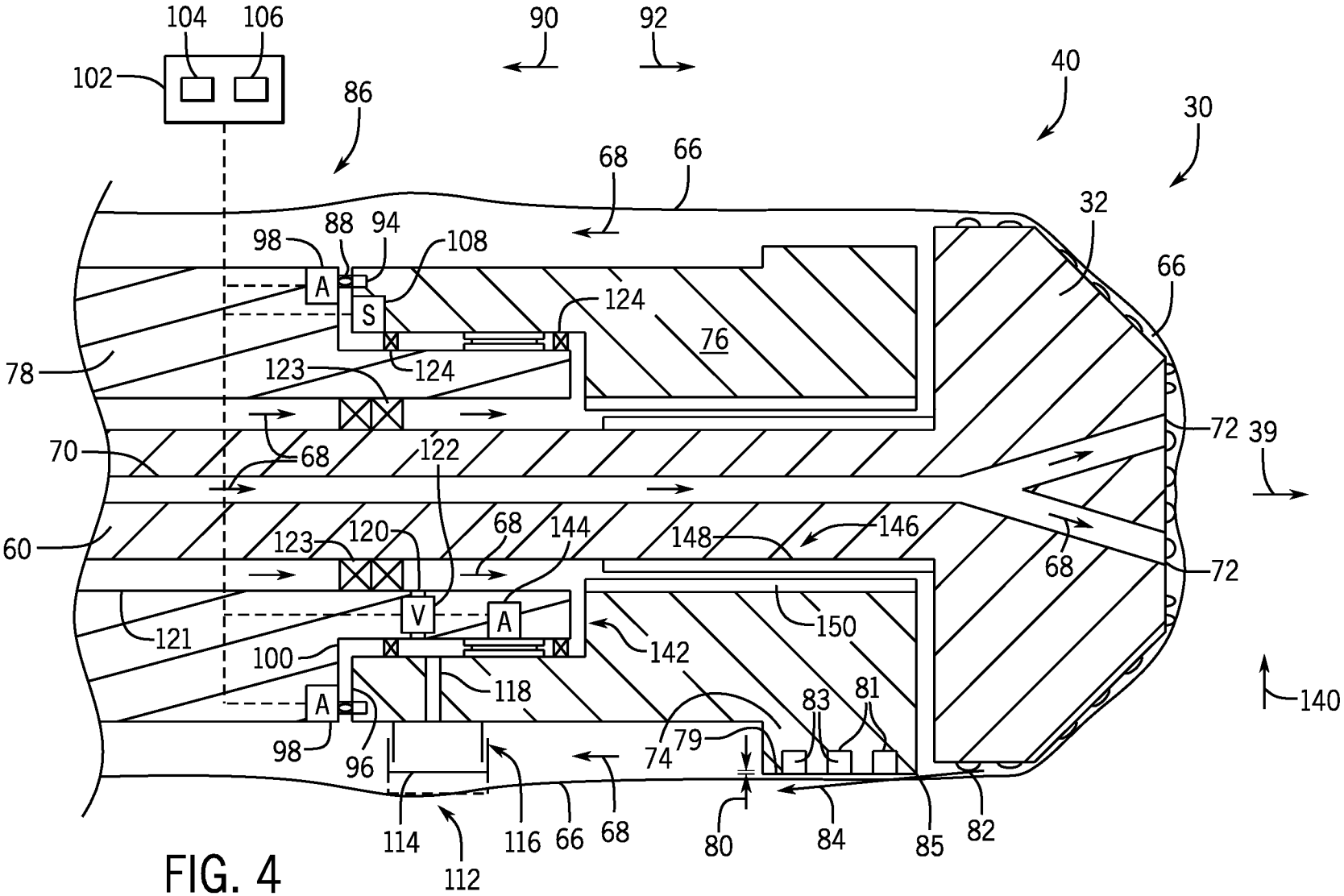
FIG. 4 is a cross-sectional view of a directional drilling system with a rotary steering system according to an embodiment of the present disclosure.

FIG. 4 is a cross-sectional view of an embodiment of a directional drilling system 30 with a rotary steering system 40 of the present disclosure. As explained above, directional drilling enables the drill bit 32 to repeatedly change orientation between the rig 14 and a reservoir 12. Accordingly, after drilling with the drill bit 32 in a first direction, it may be desirable to change the drilling direction 39. In order to change the position of the steering pad 74, the controller 102 shuts the valve 122, enabling the hydraulic piston 116 to radially retract and reduce the contact force between the brake pad 114 and the rock face 66. The controller 102 also signals the actuators 98 to drive the pins 88 into the apertures 94 to couple the housing 78 to the steering sleeve 76. Once coupled, the torque from the housing 78 is transferred to the steering sleeve 76, rotating the steering sleeve 76 and the steering pad 74. As the steering sleeve 76 rotates, the controller 102 receives feedback from the sensor 108, enabling the controller 102 to determine when the steering pad 74 is in the desired position. Once the steering pad 74 is in the desired position, the controller 102 may control the actuators 98 to retract the pins 88, enabling the housing 78 to rotate relative to the steering sleeve 76. The valve 122 may again be opened, enabling pressurized drilling mud 68 to actuate the hydraulic piston 116. As the hydraulic piston 116 moves radially outward with respect to the steering sleeve 76, the brake pad 114 again contacts the rock face 66, reducing and/or blocking rotation of the steering sleeve 76. As illustrated in FIG. 4, the steering sleeve 76 and steering pad 74 have been rotated one hundred and eighty degrees from their position in FIG. 3. In this rotated position, the steering pad 74 creates a (passive/reaction) force through contact with the rock face 66 that drives the drilling bit 32 toward lateral direction 140.

In some embodiments, the rotary steering system 40 may include a sleeve brake system 142 that through a slowing force of friction facilitates alignment between the housing 78 and the steering sleeve 76 in order to align the pins 88 (or dogs with teeth, or other mechanism known in the art to selectively lock and unlock a torsional coupling) with the apertures 94. For example, the sleeve brake system 142 may slow rotation of the housing 78 and/or steering sleeve 76 in order to align the housing 78 with steering sleeve 76 before actuation of the locking system 86. The sleeve brake system 142 also may provide for adjustable coupling torque to facilitate locating the bit toolface and setting direction. The sleeve brake system 142 may be a mechanical system, an electromechanical system (e.g., magnets), or a hydro-mechanical system (e.g., powered by drilling mud). In order to actuate the sleeve brake system 142, the controller 102 may control an actuator 144 in response to feedback from the sensor 108 indicating the position of the steering sleeve 76 relative to the housing 78. In some embodiments, the sleeve brake system 142 may replace or supplement the locking mechanism 86 (e.g., operate as a primary or secondary locking system). For example, the sleeve brake system 142 may generate sufficient force to couple the housing 78 and the steering sleeve 76 together to block and/or reduce relative motion between the two without the locking system 86.

In some embodiments, the rotary steering system 40 may include a bearing system 146 that enables and/or facilitates rotation of the steering sleeve 76 relative to the shaft 60. The bearing system 146 includes an inner bearing 148 and an outer bearing 150. The inner bearing 148 couples to and rotates with the shaft 60, while the outer bearing 150 couples to the steering sleeve 76.

Figure 5:
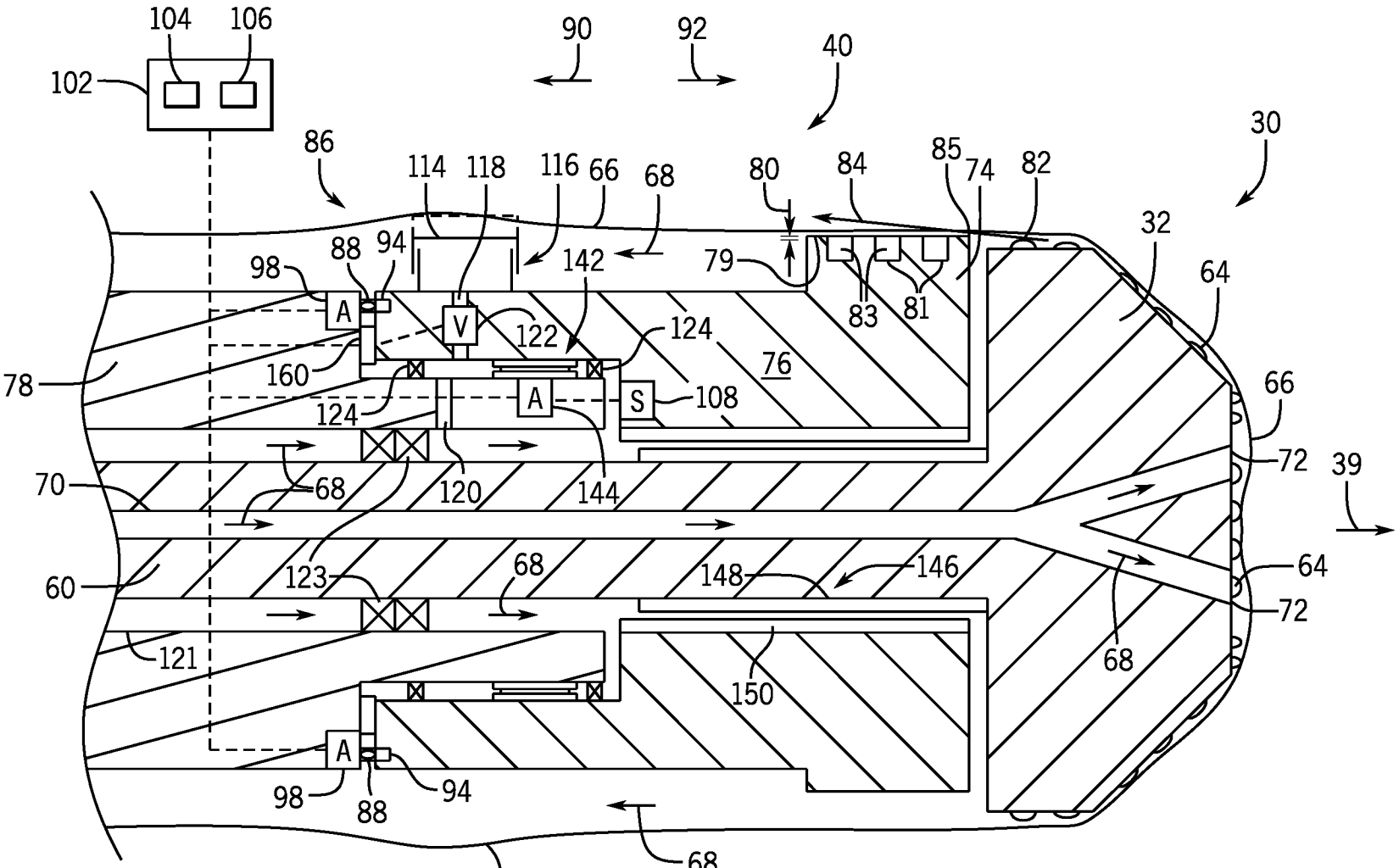
FIG. 5 is a cross-sectional view of a directional drilling system with a rotary steering system according to an embodiment of the present disclosure.

FIG. 5 is a cross-sectional view of an embodiment of a directional drilling system 30 with a rotary steering system 40 of the present disclosure. The rotary steering system 40 is similar to that described above with reference to FIGS. 3 and 4. However, FIG. 5 illustrates that the rotary steering system 40 may place the valve 122 and sensor 108 in different locations. For example, instead of coupling the valve 122 to the housing 78, the embodiment in FIG. 5 couples the valve 122 to the steering sleeve 76 to control the fluid flow through the aperture 118. Similarly, instead of coupling the sensor 108 (e.g., position sensor) to the housing 78, the sensor 108 may be coupled to the steering sleeve 76. In some embodiments, the rotary steering system 40 may include a clutch 160 (e.g., annular clutch) that blocks and/or reduces the level of torque transferred from the housing 78 to the pins 88 when coupled to the steering sleeve 76. In some embodiments, the clutch 160 may be controlled by the controller 102 in response to feedback from sensors (e.g., sensors 108) that detect torque and/or rotational speeds of the directional drilling system 30 (e.g., housing 78, steering sleeve 76).

Figure 6:
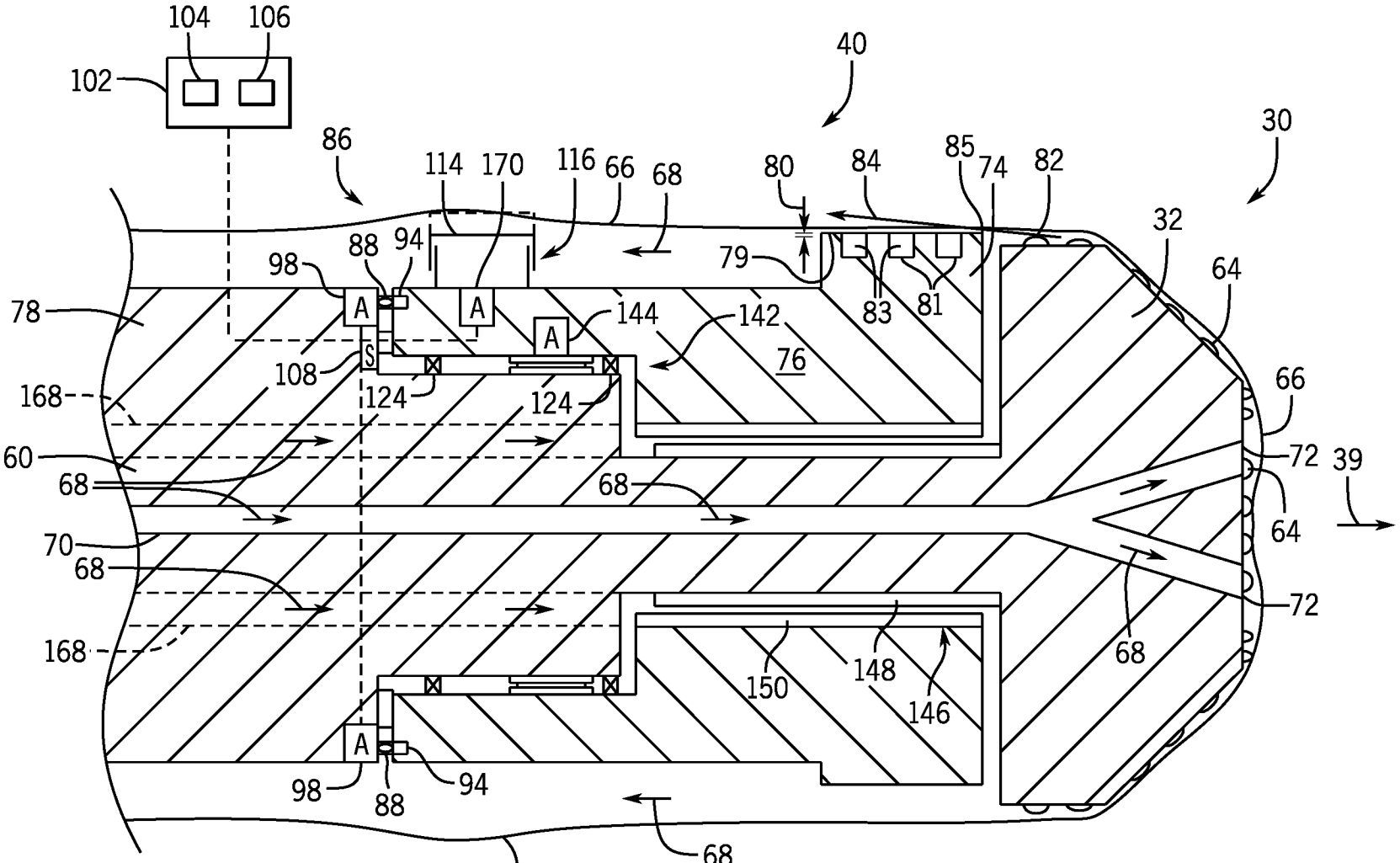
FIG. 6 is a cross-sectional view of a directional drilling system with a rotary steering system according to an embodiment of the present disclosure.

FIG. 6 is a cross-sectional view of an embodiment of a directional drilling system 30 with a rotary steering system 40 of the present disclosure. The rotary steering system 40 is similar to that described above with reference to FIGS. 3-5. However, in FIG. 6 the housing 78 and drive shaft 60 may be one piece. In operation, rotation of the drilling string 34 (e.g., by a top drive 38) rotates the housing 76 and drive shaft 60, which in turn rotates the drill bit 32. The bearing system 146 therefore may be fed with drilling mud 68 through apertures 168 instead of through the cavity 121 described above.

FIG. 6 also illustrates that the rotary steering system 40 may include a different actuator for actuating the piston 116, as well as different placement of the actuator that controls the sleeve brake system 142. As explained above, the position of the brake pad 114 may be controlled by a hydraulic piston 116 that moves radially with respect to the steering sleeve 76 in response to pressurized drilling fluid. However, in FIG. 6 the rotary steering system 40 may include a non-hydraulic actuator 170. For example, the actuator 170 may be a mechanical actuator (e.g., jackscrew) that couples to the steering sleeve 76. In operation, the mechanical actuator 170 radially extends and retracts the piston 116 with respect to a longitudinal axis of the steering sleeve 76. Furthermore, FIG. 6 illustrates that the actuator 144 for the sleeve brake system 142 may be coupled to the steering sleeve 76 instead of the housing 78.

Figure 7:
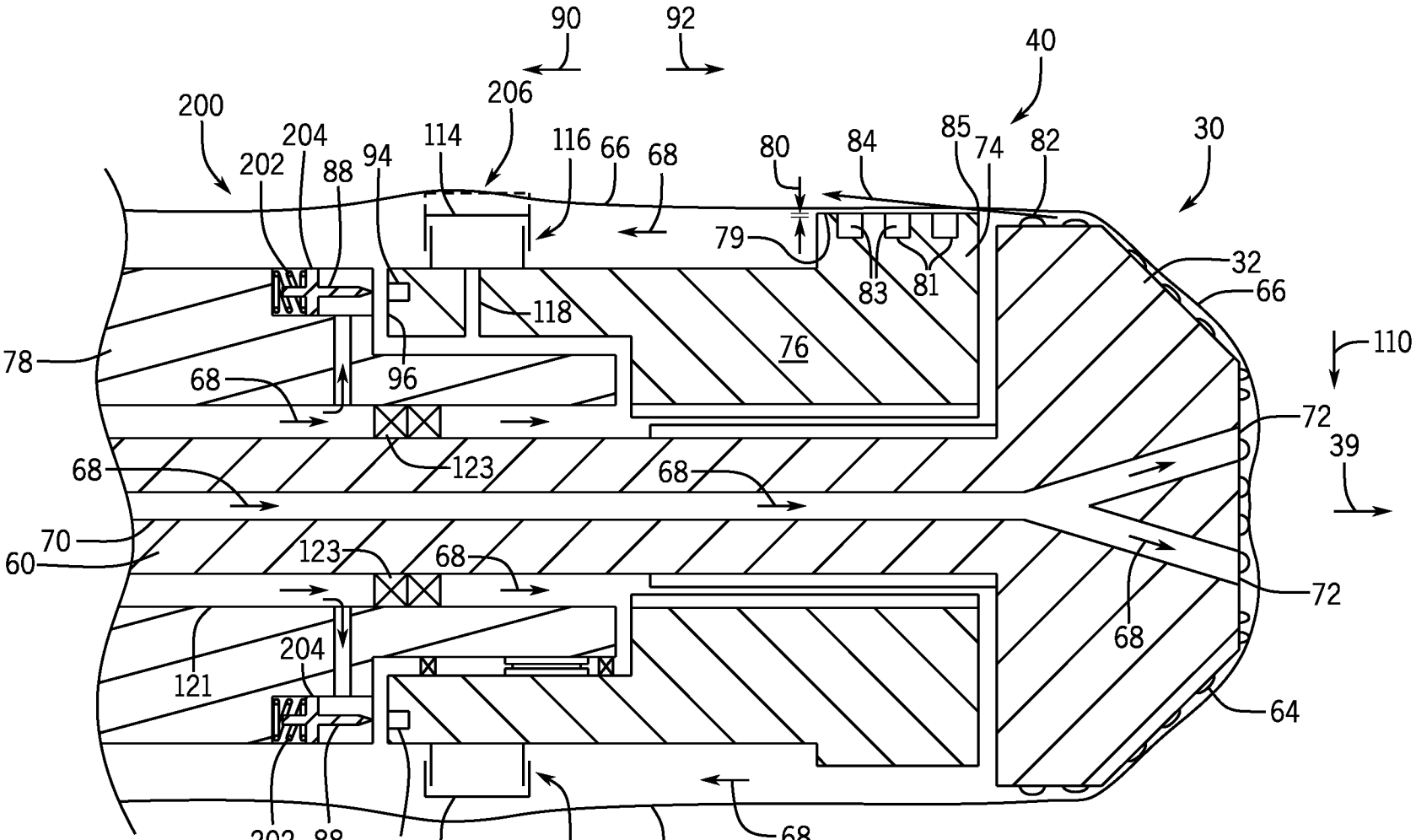
FIG. 7 is a cross-sectional view of a directional drilling system with a rotary steering system according to an embodiment of the present disclosure.

FIG. 7 is a cross-sectional view of an embodiment of a directional drilling system 30 with a rotary steering system 40 of the present disclosure. Similar to the discussion above, the rotary steering system 40 in FIG. 7 includes a locking system 200 that couples and uncouples the housing 78 to and from the steering sleeve 76. The locking system 200 may include one or more pins 88 (e.g., one, two, three, four, five, six, seven, eight, nine, ten or more pins) that move axially in directions 90 and 92 to couple and uncouple the steering sleeve 76 to and from the housing 78. More specifically, the pins 88 engage apertures 94 on the end face 96 of the steering sleeve 76 to couple the housing 78 to the steering sleeve 76. In some embodiments, the pins 88 may be oriented to move radially in order to couple and uncouple the housing 78 to and from the steering sleeve 76. For example, the pins 88 may radially engage a portion of the steering sleeve 76 overlapped by the housing 78.

As illustrated, the pins 88 are controlled with springs 202 (e.g., actuators) that respond to the flow of pressurized drilling fluid (e.g., drilling mud) that flows through the directional drilling system 30. In FIG. 7, the pins 88 are in a retracted position due to the pressurized drilling fluid driving pistons 204 in axial direction 90. As the pistons 204 move in axial direction 90, the pistons 204 compress the springs 202, enabling the pins 88 to retract. Retraction of the pins 88 uncouples the steering sleeve 76 from the housing 78, enabling the steering sleeve 76 and the housing 78 to move independently. That is, the housing 78 is able to rotate while the steering sleeve 76 remains stationary or substantially stationary (e.g., non-rotationary with respect to the borehole/earth). However, when the drilling fluid is depressurized, the springs 202 drive the piston 204 and pins 88 in axial direction 92 coupling the housing 78 to the steering sleeve 76. The housing 78 may then be rotated along with the steering sleeve 76 from a first position to a second position in order to reposition the steering pad 74. Once repositioned, the drilling fluid may again be pressurized to uncouple the pins 88 from the steering sleeve 76.

As pressurized drilling fluid drives operation of the locking system 200, it also actuates a steering brake system 206. The steering brake system 206 includes one more brake pads 114 that move both radially outward and inward to engage with and disengage from the rock face 66 to maintain the steering pad 74 in a specific position relative to the bore/earth. The brake pads 114 are actuated with a hydraulic piston 116. When the drilling fluid is pressurized, drilling fluid may flow through the apertures 118 to actuate the hydraulic piston 116. Actuation of the hydraulic piston 116 drives the brake pads 114 radially outward with respect to the steering sleeve 76 and into contact with the rock face 66. The friction between a brake pad 114 and the rock face 66 reduces or blocks rotation of the steering sleeve 76 and thus maintains the steering pad 74 in a desired position to control the drilling direction 39 of the drill bit 32. However, when the drilling fluid is depressurized, friction between the brake pads 114 and the rock face 66 is reduced, enabling the steering sleeve 76 to rotate with the housing 78. In this way, the steering system 40 uses the pressure of the drilling fluid to both couple and uncouple the steering sleeve 76 to and from the housing 78 while also controlling actuation of the steering brake system 206.

Figure 8:
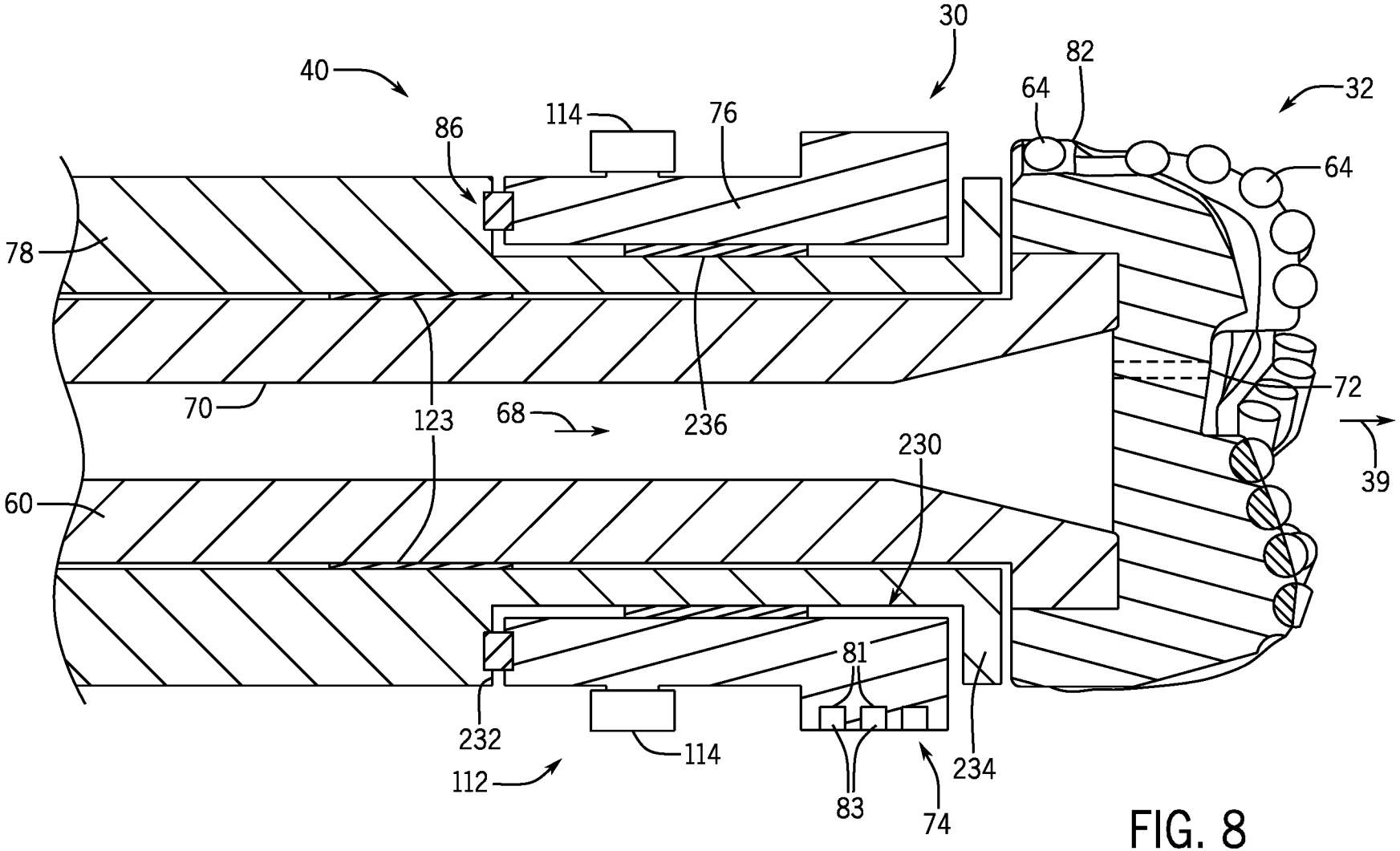
FIG. 8 is a cross-sectional view of a directional drilling system with a rotary steering system according to an embodiment of the present disclosure.

FIG. 8 is a cross-sectional view of an embodiment of a directional drilling system 30 with a rotary steering system 40. The rotary steering system 40 is similar to that described above. However, FIG. 8 illustrates a housing 78 with a groove 230 that receives the steering sleeve 76 between opposing first and second shoulders 232 and 234. Placement of the steering sleeve 76 in this groove 230 enables the shoulders 232 and 234 to reduce axial movement of the steering sleeve 76 with respect to the drill bit 32 (i.e., block contact between the steering sleeve 76 and the drill bit 32). To facilitate movement of the steering sleeve 76 relative to the housing 78, the steering system 40 includes a bearing 236. In some embodiments, the bearing 236 may be a radial and axial bearing that enables the steering sleeve 76 to rotate relative to the housing 78. As explained above, the steering sleeve 76 rotates relative to the housing 78 to enable the repositioning of one or more steering pads 74 from a first circumferential position to a second circumferential position relative to the bore/earth to change the drilling direction 39.

Figure 9:
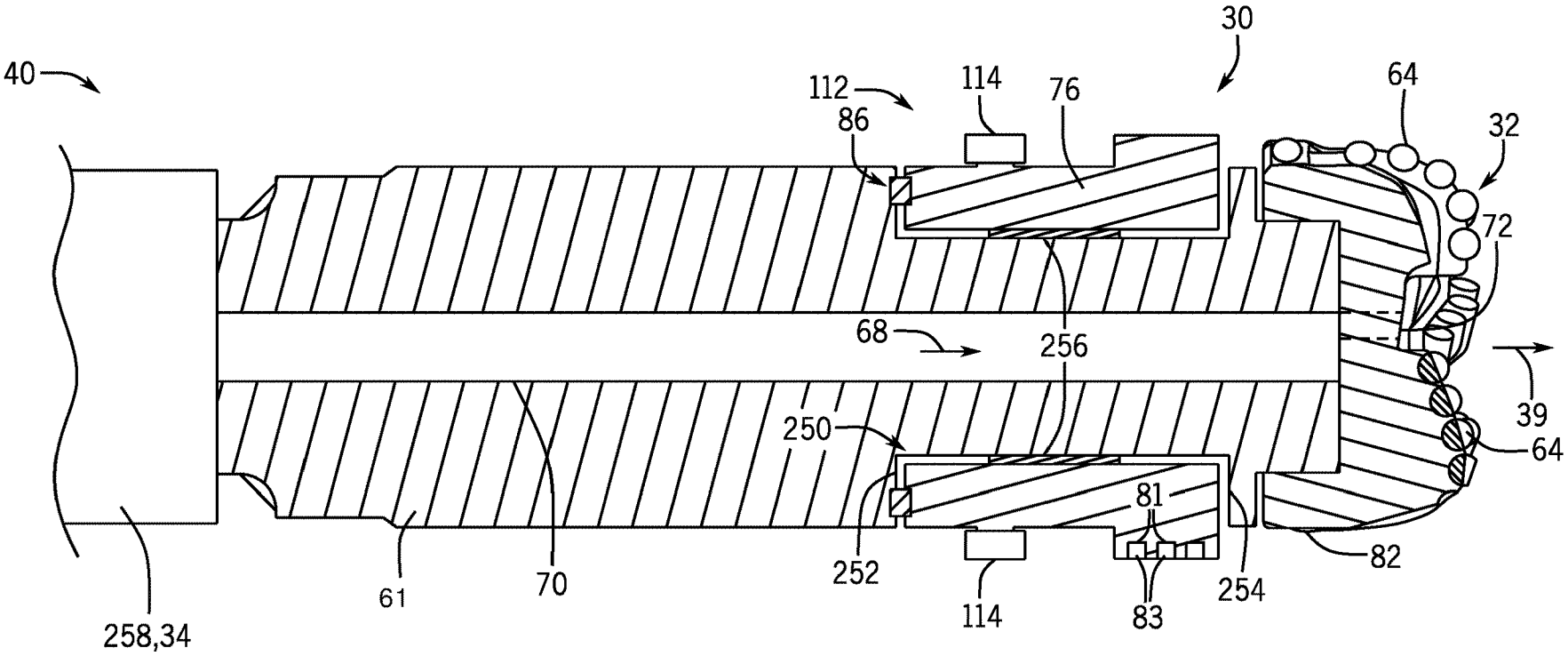
FIG. 9 is a cross-sectional view of a directional drilling system with a rotary steering system according to an embodiment of the present disclosure.

FIG. 9 is a cross-sectional view of an embodiment of a directional drilling system 30 with a rotary steering system 40. The rotary steering system 40 is similar to that described above. However, FIG. 9 illustrates a unit 61 with a groove 250 that receives the steering sleeve 76 between opposing first and second shoulders 252 and 254. Placement of the steering sleeve 76 in this groove 250 enables the shoulders 252 and 254 to reduce axial movement of the steering sleeve 76 with respect to the drill bit 32 (i.e., block contact between the steering sleeve 76 and the drill bit 32). To facilitate movement of the steering sleeve 76 relative to the unit 61, the steering system 40 includes a bearing 256. In some embodiments, the bearing 256 may be a radial and axial bearing that enables the steering sleeve 76 to rotate relative to the unit 61. As explained above, the steering sleeve 76 rotates to enable the repositioning of one or more steering pads 74 from a first circumferential position to a second circumferential position relative to the bore/earth to change the drilling direction 39. As illustrated, the unit 61 may couple to a motor 258. The motor 258 may be a mud motor or an electric motor that provides torque to the unit 61 to rotate the drill bit 32. In some embodiments, the unit 61 may couple directly to the drill string 34, enabling the unit 61 to receive torque from a top drive 38, kelly drive and/or rotary table.

The steering assembly of the present disclosure may be part of, or fixedly coupled or adjustably coupled to, a mud motor, a turbine, an electric motor, or any other suitable component along a drill string. The steering assembly of the present disclosure may be manufactured, formed, or assembled separately from, or as an integral part of (in a single piece) with, any one or more of such other drill string component(s).

The embodiments discussed above are susceptible to various modifications and alternative forms, specific embodiments have been shown by way of example in the drawings and have been described in detail herein. However, it should be understood that the embodiments are not intended to be limited to the particular forms disclosed.

The invention claimed is:

1. A drilling system, comprising:

a drill bit configured to drill a bore through rock;

a shaft coupled to the drill bit, wherein the shaft is configured to transfer rotational power to the drill bit;

a housing configured to receive at least part of the shaft;

a rotary steering system configured to control a drilling direction of the drill bit, the rotary steering system comprising:

a steering sleeve configured to couple to and uncouple from the housing to control a drilling direction of the drill bit; and a steering pad coupled to the steering sleeve, wherein the steering pad is over-gauge a radial distance relative to the drill bit when the steering sleeve is coupled to the housing and when the steering sleeve is uncoupled from the housing; and a locking mechanism configured to couple and uncouple the steering sleeve from the housing, wherein the locking mechanism comprises one or more pins configured to move axially with respect to a longitudinal axis of the steering sleeve to engage with one or more apertures when the steering sleeve is coupled to the housing.

2. The drilling system of claim 1, wherein the steering pad is configured to rotate with the steering sleeve and to form a steering angle with the drill bit.

3. The drilling system of claim 1, wherein the rotary steering system comprises:

a piston coupled to the steering sleeve, wherein the piston is configured to move radially with respect to the longitudinal axis of the steering sleeve to engage a brake pad with and disengage the brake pad from an external rock face.

4. The drilling system of claim 3, wherein the housing comprises a valve configured to control a flow of a fluid to actuate the piston.

5. The drilling system of claim 3, wherein the steering sleeve comprises a valve configured to control a flow of a fluid to actuate the piston.

6. The drilling system of claim 1, wherein the locking mechanism comprises one or more actuators configured to extend and retract the one or more pins from the housing to couple and uncouple the steering sleeve from the housing.

7. The drilling system of claim 1, comprising:

a clutch between the steering sleeve and the housing, wherein the clutch is configured to reduce torque on the locking mechanism.

8. The drilling system of claim 1, wherein the rotary steering system comprises:

a sleeve brake configured to change a rotational speed of the steering sleeve relative to the housing.

9. The drilling system of claim 1, comprising:

a bearing between the steering sleeve and the shaft, wherein the bearing enables the shaft to rotate relative to the steering sleeve.

10. A system for controlling a drilling direction of a drill bit, the system comprising:

a housing; and a rotary steering system comprising:

a steering sleeve configured to couple to and uncouple from the housing;

a steering pad coupled to the steering sleeve, wherein the steering pad is configured to rotate with the steering sleeve and to form a steering angle with the drill bit, wherein the steering pad is over-gauge a radial distance relative to the drill bit when the steering sleeve is coupled to the housing and when the steering sleeve is uncoupled from the housing; and a piston coupled to the steering sleeve, wherein the piston is configured to move radially with respect to a longitudinal axis of the steering sleeve to engage a brake pad with and disengage the brake pad from an external rock face, wherein the housing comprises an actuator configured to extend and retract the piston.

11. The system of claim 10, wherein the actuator comprises a valve configured to control a flow of a fluid to actuate the piston.

12. The system of claim 10, comprising:

a locking mechanism configured to couple and uncouple the steering sleeve from the housing.

13. The system of claim 12, comprising:

a clutch between the steering sleeve and the housing, wherein the clutch is configured to reduce torque on the locking mechanism.

14. The system of claim 10, comprising:

a sleeve brake configured to change a rotational speed of the steering sleeve relative to the housing.

15. The system of claim 10, comprising:

a bearing between the steering sleeve and a shaft that powers the drill bit, wherein the bearing enables the shaft to rotate relative to the steering sleeve.

16. A method of controlling a drilling direction of a drill bit, comprising:

disconnecting a steering sleeve from a housing, wherein the steering sleeve comprises a steering pad configured to form a steering angle with the drill bit, wherein the steering pad is over-gauge a radial distance relative to the drill bit when the steering sleeve is disconnected from the housing and when the steering sleeve is connected to the housing;

actuating a piston to move radially with respect to a longitudinal axis of the steering sleeve to limit rotation of the steering pad, wherein actuating the piston comprises controlling a valve configured control a flow of a fluid to an actuator configured to extend and retract the piston; and actuating one or more pins between the housing and the steering sleeve to connect the steering sleeve with the housing, wherein the one or pins are configured to move axially with respect to the longitudinal axis of the steering sleeve.

17. The method of claim 16, comprising:

retracting the piston and rotating the steering sleeve from a first position to a second position.

18. The method of claim 17, comprising:

actuating the piston to limit rotation of the steering sleeve from the second position.

* * * * *